US006279216B1

(12) United States Patent
Halliday et al.

(10) Patent No.: US 6,279,216 B1
(45) Date of Patent: Aug. 28, 2001

(54) PIN EXTRACTION TOOL

(75) Inventors: Thomas A. Halliday, Ocean; Liang Hwang, Old Bridge, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/447,775

(22) Filed: Nov. 23, 1999

(51) Int. Cl.[7] ..... B25B 27/14

(52) U.S. Cl. ..... 29/280; 29/278; 81/345

(58) Field of Search ..... 29/278, 280; 81/345

(56) References Cited

U.S. PATENT DOCUMENTS 3,008,228 * 11/1961 Crotty ..... 29/278

* cited by examiner

*Primary Examiner*—Lee Young
*Assistant Examiner*—Rick Kiltae Chang
(74) *Attorney, Agent, or Firm*—David L. Davis

(57) ABSTRACT

A tool for extracting a press fit pin from a pin field in a backplane of an electronic system. The tool includes a shaft having first and second ends, with a chuck mounted to the first end and an abutment mounted to the second end. The chuck has a plurality of jaws adapted to grip the pin therebetween and a weight is slidably mounted on the shaft between the chuck and the abutment. After a pin is held by the chuck, the weight is slid along the shaft to contact the abutment and the kinetic energy imparted by the weight to the shaft acts to pull the pin out of the backplane.

7 Claims, 3 Drawing Sheets

PIN EXTRACTION TOOL

BACKGROUND OF THE INVENTION

This invention relates to a pin field on a backplane of an electronic system and, more particularly, to a tool for extracting a selected pin from the pin field.

Modern electronic systems equipment, such as for telecommunications purposes, is often constructed as modular circuit packs inserted into guide slots of mechanical card cages, or shelf units, for engagement with a backplane mounted to the shelf unit at the inward ends of the guide slots. Such a backplane typically includes a pin field with delicate pins press fit into openings in the backplane for the interconnection of the circuit packs. These pins are sometimes damaged and can be difficult to repair or replace due to the tight packing of the pin field.

Tools are currently available for extracting a pin from such a pin field. However, such commercially available tools all suffer from a number of disadvantages. The tools typically include a trigger-like operating mechanism in a bulky housing which blocks the visibility of the pin to be removed. Also, since the housing is relatively bulky, it is difficult to maneuver the tool close to the side of the card cage. Further, it may be necessary to remove adjacent circuit packs to have access to a damaged pin, which disrupts the operation of the system. Still further, all such tools are relatively expensive.

Accordingly, it would be desirable to have a pin extraction tool which is economical and does not suffer from the aforedescribed disadvantages.

SUMMARY OF THE INVENTION

The present invention provides a tool for extracting a press fit pin from an opening in an object. The tool comprises a shaft having first and second ends and a chuck mounted to the first end of the shaft, with the chuck having a plurality of jaws adapted to grip the pin therebetween. An abutment is secured to the second end of the shaft and a weight is slidably mounted on the shaft between the chuck and the abutment. Accordingly, after a pin is held by the chuck, the weight is slid along the shaft to contact the abutment. The kinetic energy imparted by the weight to the shaft acts to pull the pin from the opening in the object.

In accordance with an aspect of this invention, each of the jaws has an internal gripping surface and an opposed external camming surface which tapers outwardly from the first end of the shaft. The chuck further includes a sleeve slidable over the plurality of jaws. The sleeve cooperates with the camming surfaces to cause the internal gripping surfaces to move toward each other as the sleeve is moved away from the shaft first end.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
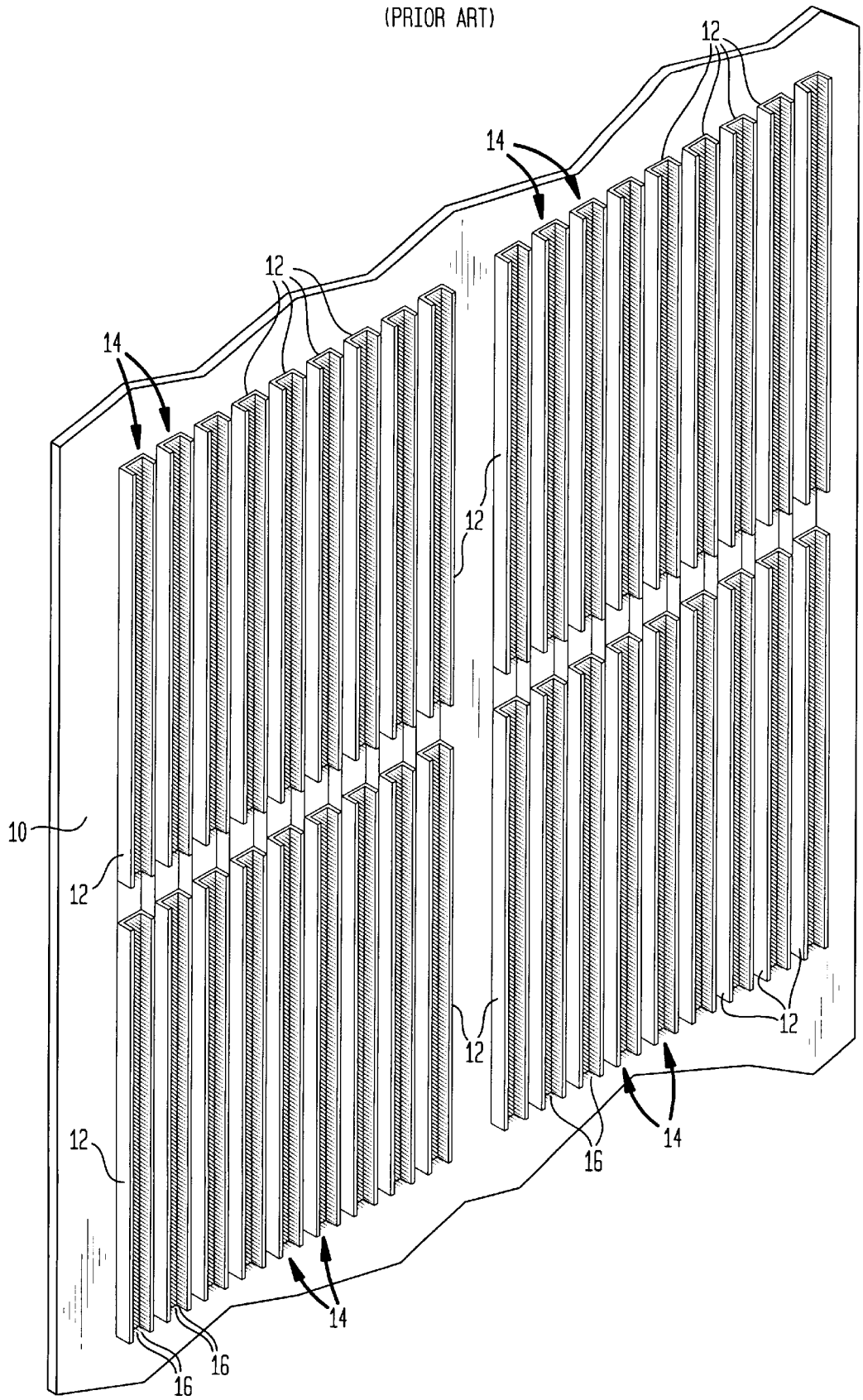
FIG. 1 (PRIOR ART)
FIG. 1 is a perspective view of a typical backplane having pins which are removable by the inventive tool.

FIG. 1 illustrates a portion of a typical backplane 10 with which the present invention finds utility. Mounted to the backplane 10 are a plurality of connector blocks 12, each of which contains a perspective pin field 14. The pin fields 14 are made up of a plurality of individual pins 16 which are press fit into openings extending through the backs of the connector blocks 12 and through the backplane 10. Although not shown in FIG. 1, on the reverse side of the backplane 10 are additional connector blocks including pin fields made up of the pins 16 which extend on both sides of the backplane 10.

Figure 2:
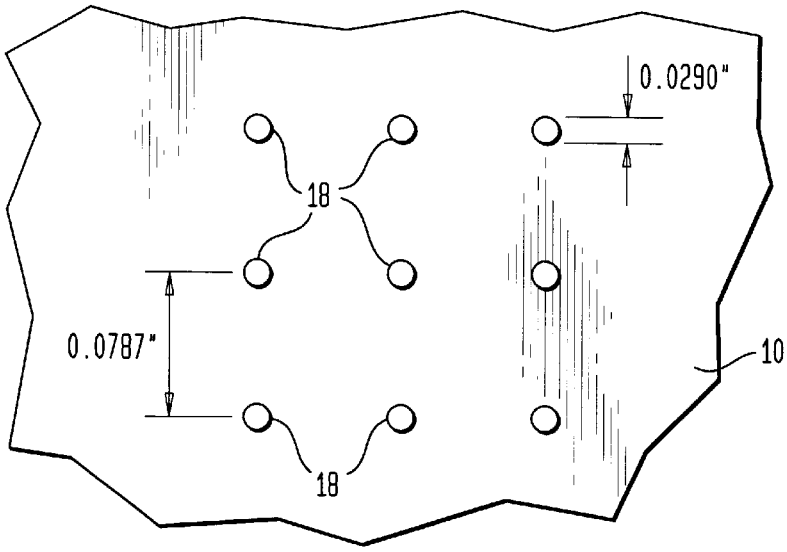
FIG. 2 (PRIOR ART)
FIG. 2 shows an illustrative spacing between the pins in the backplane shown in FIG. 1.
Figure 3:
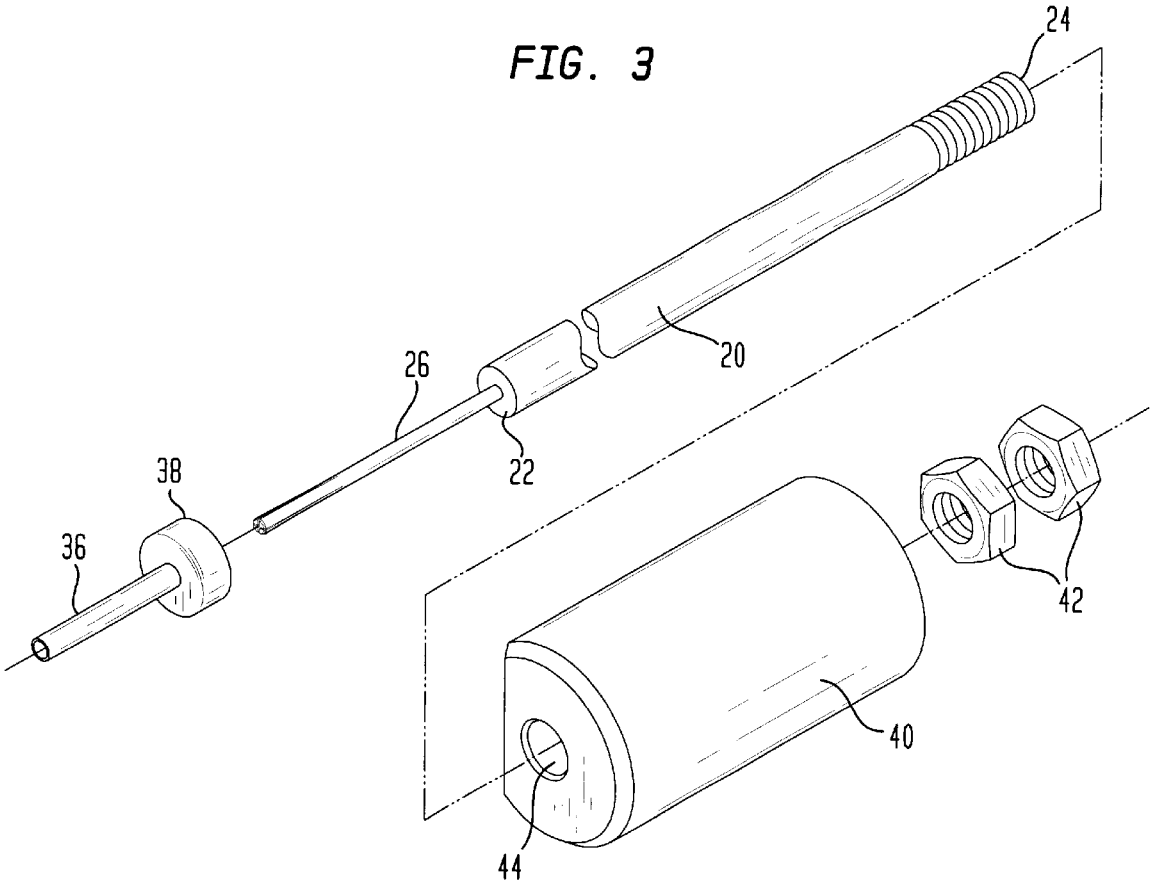
FIG. 3 is an exploded perspective view of a tool constructed in accordance with the principles of this invention.

FIG. 2 illustrates a typical spacing between openings 18 in the backplane board 10 for accepting the pins 16 of the pin fields 14. As shown, each of the openings 18 illustratively has a diameter equal to 0.0290 inches and the center-to-center spacing between the openings 18 is illustratively 0.0787 inches. Simple arithmetic shows that a pin extraction tool centered at one of the openings 18 can have a maximum outer diameter at its front end equal to 0.1284 inches.

Figure 4:
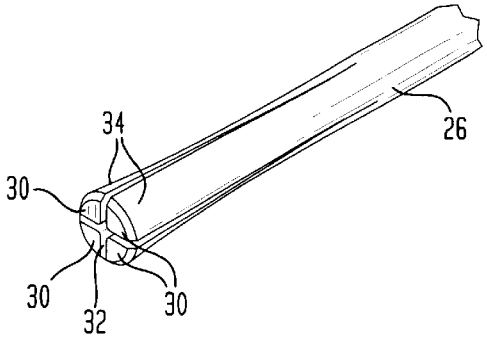
FIG. 4 is an enlarged perspective view showing the jaws of the inventive tool.
Figure 5:
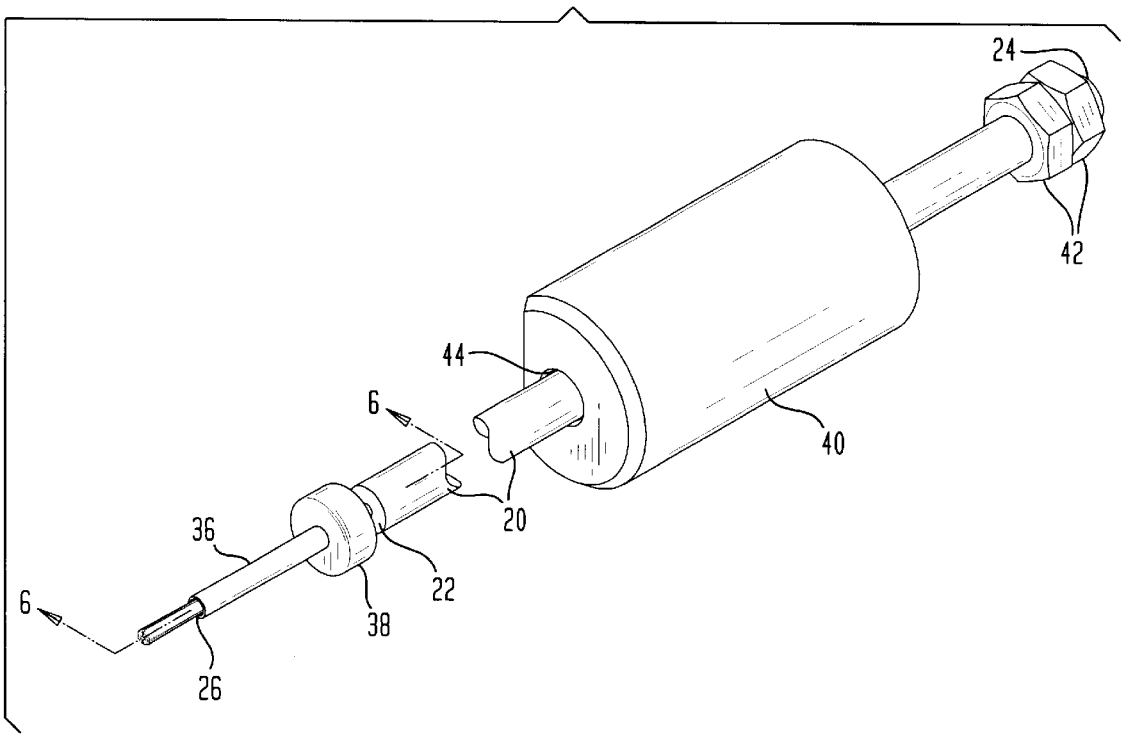
FIG. 5 is a perspective view of the assembled tool shown in FIG. 3.
Figure 6:
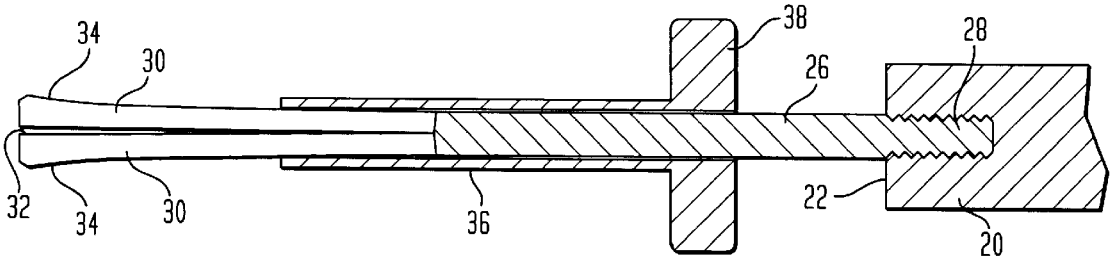
FIG. 6 is a cross sectional view of the front end of the tool taken along the line 6—6 in FIG. 5.

As shown in FIGS. 3–6, a tool constructed in accordance with the principles of this invention includes a shaft 20 having a first end 22 and a second end 24. A shaft extension 26 is secured to the first end 22 of the shaft 20. The shaft extension 26 is preferably of smaller diameter than the shaft 20 and has a threaded end 28 engaging a suitably internally threaded axial bore at the first end 22 of the shaft 20, as shown in FIG. 6, so that the shaft extension 26 is coaxially mounted with respect to the shaft 20. At the forward end of the shaft extension 26, remote from the threaded end 28, the shaft extension 26 is slotted, as best shown in FIG. 4. Illustratively, there are two perpendicular slots intersecting along the axis of the shaft extension 26. In effect, the intersecting slots form a central axial bore and a plurality of slots extending radially from the bore and longitudinally the length of the bore so as to form four jaws 30. Although four jaws 30 have been shown, it is understood that the present invention can utilize three jaws which would be formed by a central axial bore and three slots extending radially from the central axial bore and displaced angularly by 120° about the axis of the shaft extension 26. Any other desired number of jaws can be similarly provided.

In any event, each of the jaws 30 has an internal gripping surface 32. As best seen from FIGS. 4 and 6, each of the jaws 30 has an external camming surface 34 which tapers outwardly away from the first end 22 of the shaft 20. Slidingly disposed on the shaft extension 26 is a sleeve 36. Together, the shaft extension 26 and the sleeve 36 form a chuck. The sleeve 36 is further formed with a flange 38 at its end closer to the shaft 20. The flange 38 may illustratively be a washer welded to the end of the sleeve 36. As the sleeve 36 is moved over the shaft extension 26 away from the shaft 20, the interior of the sleeve 36 engages the camming surfaces 34 of the jaws 30 to move the jaws 30 toward each other. The dimensions of the slots forming the jaws 30 are such that a pin 16 is insertable into the axial bore formed at the intersection of the slots. Accordingly, when the sleeve 36 is moved away from the shaft 20, the jaws 30 are moved toward each other so that the gripping surfaces 32 are moved toward each other to firmly grip the inserted pin 16. Illustratively, the outer diameter of the sleeve 36, apart from the flange 38, is chosen to be 0.125 inches so that the tool can grip a single pin 16 without interfering with any adjacent pin.

The inventive tool further includes a weight 40 slidably mounted on the shaft 20 between the first end 22 and the second end 24. Illustratively, the second end of the shaft 24 is externally threaded and a pair of nuts 42 are threaded onto the second end 24 of the shaft 20 to form an abutment cooperating with the weight 40, as will be described. Preferably, the weight 40 is formed as a flatted cylinder having an axial bore 44 sized to slidingly receive the shaft 20 therein. The use of a flatted cylinder as the weight 40 allows the tool to be placed close to the side of the card cage, an advantage as compared with previous designs.

In use, to remove a pin 16 from the pin field 14, the sleeve 36 is slid back toward the first end 22 of the shaft 20. The tool is then moved toward the pin field 14 and is maneuvered so that the selected pin 16 is inserted within the jaws 30. Since the tool is relatively narrow, there is no blocking of the visibility of the jaws 30 and the pins 16. Also, a minimum number of circuit packs need to be removed. After the selected pin is within the jaws 30, the weight 40 is slid along the shaft 20 to engage the flange 38 and move the sleeve 36 over the camming surfaces 34, so that the selected pin 16 is tightly gripped by the jaws 30. The weight 40 is then slid toward the second end 24 of the shaft 20 to contact the abutment formed by the nuts 42. The kinetic energy imparted by the weight 40 to the shaft 20 through the nuts 42 acts to pull the selected pin 16 from its opening 18 in the backplane 10.

Accordingly, there has been disclosed an improved tool for extracting a selected pin from a pin field on a backplane of an electronic system. While an illustrative embodiment of the present invention has been disclosed herein, it is understood that various adaptations and modifications to the disclosed embodiment are possible, and it is intended that this invention be limited only by the scope of the appended claims.

What is claimed is:

1. A tool for extracting a press fit pin from an opening in an object, comprising:

a shaft having first and second ends;

a chuck mounted to said shaft first end, said chuck having a plurality of jaws adapted to grip said pin therebetween;

an abutment secured to said shaft second end; and a weight slidably mounted on said shaft between said chuck and said abutment and said shaft extending through the weight;

whereby after said pin is held by said chuck, said weight is slid along said shaft to contact said abutment, and kinetic energy imparted by said weight to said shaft acts to pull said pin from said opening in said object.

2. The tool according to claim 1 wherein each of said plurality jaws has an internal gripping surface and an opposed external camming surface which tapers outwardly away from said shaft first end, and said chuck further includes a sleeve slidable over said plurality of jaws, said sleeve cooperating with said camming surfaces to cause said internal gripping surfaces to move toward each other as said sleeve is moved away from said shaft first end.

3. The tool according to claim 2 wherein said sleeve includes a sleeve abutment engageable by said weight;

whereby after said pin is placed within said jaws, said weight is slid along said shaft to contact said sleeve abutment and move said sleeve over said camming surfaces so that said jaws firmly grip said pin.

4. The tool according to claim 1 wherein said weight is formed as a flatted cylinder having an axial bore sized to slidingly receive said shaft therein.

5. The tool according to claim 1 wherein said chuck comprises:

a shaft extension coaxially secured to said shaft first end, a end of said shaft extension which is remote from said shaft first end having an axial bore and a plurality of slots extending radially from said bore and longitudinally a length of said bore so as to form said plurality of jaws, and said shaft extension tapering outwardly away from said shaft first end to form a plurality of camming surfaces each on a respective one of said jaws; and a sleeve slidable over said shaft extension, said sleeve cooperating with said camming surfaces to cause said jaws to move toward each other as said sleeve is moved away from said shaft first end.

6. The tool according to claim 5 wherein said shaft extension has a smaller outer diameter than said shaft and said sleeve is confined to movement along said shaft extension and is prevented from moving along said shaft.

7. The tool according to claim 5 wherein said sleeve includes an abutment engageable by said weight;

whereby after said pin is placed within said jaws, said weight is slid along said shaft to contact said sleeve abutment and move said sleeve over said camming surfaces so that said jaws firmly grip said pin.

* * * * *